United States Patent [19]

Ito et al.

[11] Patent Number: 4,524,577

[45] Date of Patent: Jun. 25, 1985

[54] TWISTED YARN

[75] Inventors: Osamu Ito, Utsunomiya; Harumasa Yamasaki; Itsuo Minakata, both of Wakayama; Kazunori Nishizawa, Funabashi, all of Japan

[73] Assignee: Kao Corporation, Tokyo, Japan

[21] Appl. No.: 448,555

[22] Filed: Dec. 10, 1982

[30] Foreign Application Priority Data

Dec. 18, 1981 [JP] Japan ..... 56-204696

[51] Int. Cl.[3] ..... D02G 3/02; D02G 3/04; D02G 3/26; D02G 3/28

[52] U.S. Cl. ..... 57/200; 8/120; 8/130.1; 8/131; 57/236; 57/238; 57/241; 57/243; 57/250; 57/252; 57/257; 57/258; 8/116.1

[58] Field of Search ..... 57/250, 243, 257, 258, 57/239, 241, 246, 252, 254, 256, 200, 238, 236; 8/120–122, 129–132, 115.5–116 R, 125, 127

[56] References Cited

U.S. PATENT DOCUMENTS

| | | | |
|---|---|---|---|
| 3,220,085 | 11/1965 | Lund et al. | 57/257 X |
| 3,369,281 | 2/1968 | Edlich et al. | 57/241 X |
| 3,425,208 | 2/1969 | Shippee et al. | 57/258 X |
| 3,822,994 | 7/1974 | De Boer et al. | 57/258 X |
| 3,971,093 | 7/1976 | Komatsu et al. | 57/257 X |

*Primary Examiner*—John Petrakes

*Attorney, Agent, or Firm*—Flynn, Thiel, Boutell & Tanis

[57] ABSTRACT

The twisted yarn is prepared by twisting (1) a single yarn comprising a water-insoluble fiber having a degree of water swelling of at least 10 cc/g or (2) a plurality of single yarns comprising a water-insoluble fiber having a degree of water swelling of at least 10 cc/g or a plurality of yarns comprising at least 50% by weight of such single yarns and water-nonswellable yarns so that the twist constant is at least 2.5.

8 Claims, 4 Drawing Figures

TWISTED YARN

This invention relates to a twisted yarn and more particularly to a twisted yarn having water swellability and a special function.

As fiber materials having water swellability, there have heretofore been known a variety of fiber materials made of, for example, fibers from polyalginic acid, carboxymethylated cellulose fiber and acrylic fiber prepared by converting its nitrile groups into —COOX groups. However, among these fiber materials, those having high absorptivity (water swellability) are lacking in wet strength and wet rigidity, and so, they have a limited application and a defect that the efficiency of absorption is poor if they are incorporated in an absorbent material such as cotton pulp.

Although twisted yarns have heretofore been known, the aim of twisting is generally to impart strength, special appearance and hand to the yarn and to eliminate yarn unevenness, and no twisted yarn has been known which is given, by twisting, an ability to show excellent shrinkage when it is wetted with water.

Figure 1:
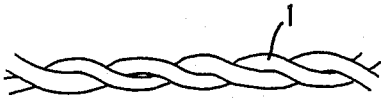
FIG. 1 is a side view of a twisted yarn of this invention.

An object of this invention is to provide a twisted yarn having water swellability and excellent strength when it is wetted with water. More particularly, an object of this invention is to provide a twisted yarn which shows excellent shrinkage when it is wetted with water, and has a water absorption shrinkage force of at least 10 g and a water absorption shrinkage rate of at least 10%.

The above-mentioned object of this invention can be achieved by twisting a yarn comprising a water-insoluble fiber and having a degree of water swelling of at least 10 cc/g so that the twist constant is at least 2.5 (in this case, a single yarn is twisted or a plurality of single yarns are twisted together) or by twisting the above water-swellable yarn together with a non-swellable yarn such as cotton yarn, rayon yarn or synthetic fiber so that the twist constant is at least 2.5. In this case, however, it is necessary to use the water-swellable yarn in an amount of at least 50% by weight. When the amount is less than 50% by weight, the water absorption capacity unfavorably decreases.

As examples of the water-swellable fiber which can be used in the twisted yarn of this invention, there can be mentioned yarns comprising fibers prepared from modified products of cellulose such as cotton or rayon, for example, carboxymethylated cotton, methylated cotton, ethylated cotton, hydroxylethylated cotton, sulfated cotton, sulfonated cotton, phosphated cotton, cationized cotton, zwitter-ionized cotton, cellulose fiber grafted with sodium acrylate, acrylic acid, acrylonitrile or acrylamide and crosslinked products thereof, products obtained by modifying wool, silk or the like in a similar manner and modified products of synthetic fibers, such as partially maleated vinylon.

In the production of the twisted yarn of this invention, it is preferred to twist a yarn after imparting water swellability thereto but it is also possible to twist a yarn before imparting water swellability thereto.

The degree of water swellability mentioned in this invention refers to apparent water swellability determined as follows: 0.2 to 0.5 g of a dry sample (prepared by disintegrating a yarn into single fibers) is weighed out (this weight is x g) and placed in a measuring cylinder, inside diameter 10 mm $\phi$. A 10 g cylindrical weight (outside diameter, about 9 mm) is placed in the cylinder so that the bottom of the weight is mounted on the sample. Then 25 to 50 cc of pure in water is poured and maintained at 25° C. and the position of the bottom of the weight elevated by swelling is read after 48 hours (this is y cc). Thus, the degree of water swelling (cc/g)=y/x.

The twist constant mentioned in this invention is a value determined according to the following expression:

$$K=T/\sqrt{N}$$

where

K: twist constant

T: number of twists per inch

N: metric count of yarn (N=n/l, when l yarns of n count are twisted)

In the case where a plurality of yarns are twisted together, the first twists are not counted in the number of twists, but in the case of a single yarn, the first twists are counted in the twist number.

The inventors of this invention have paid a special attention to an attempt to use a hydrolyzed acrylic yarn prepared by subjecting an acryonitrile-based acrylic yarn to a chemical treatment to convert its nitrile groups into carboxyl groups as a yarn comprising a water-swellable fiber, and have found that a yarn prepared by twisting the above yarn shrinks markedly when it is wetted and has elasticity.

According to the study of the inventors of this invention, it has been manifested that the water absorption shrinkage of the acrylic yarn is developed by using an acrylonitrile-based acrylic yarn as a starting material, subjecting the yarn to a chemical treatment to introduce a specified amount of salt-form carboxyl groups or a crosslinked structure thereof and giving the yarn a high twist.

A number of process for introducing carboxyl groups by hydrolysis of an acrylonitrile-based fiber with an acid or an alkali were proposed (see, for example, Japanese Patent Publication No. 110/1963, Kogyo Kagaku Zasshi 68, 1309 (1965) and Japanese Patent Laid-open No. 7526/1974). In all cases, however, the introduction of carboxyl groups was carried out for the purpose of obtaining ion exchangeability, water swellability or the like, and these methods, unlike this invention, never provide a yarn having excellent water shrinkage and elasticity by twisting the yarn. Accordingly, the twisted yarn of the invention is quite a novel yarn.

In order to achieve the above-mentioned object of this invention, it is necessary to introduce at least 0.7 mmol/g of carboxyl groups in the salt form represented by —COOX group (X: Li, K, Na or $NH_4$) into acrylic yarns and, if the amount is less than 0.7 mmol/g, the water absorption shrinkage decreases. However, if the amount of carboxyl groups introduced exceeds 4.0 mmol/g, a phenomenon occurs that the hydrolyzed acrylate yarn containing the introduced carboxyl groups dissolves when it absorbs water. This is unfavorable. Usually, a single yarn is given a so-called first twist, but this twist by itself is not sufficient and accordingly it is necessary to increase the twist constant to above 2.5 by giving an additional twist.

Here, the amount of carboxyl groups in the salt form can be determined according to the following expression:

$$\text{carboxyl content (mmol/g)} = 0.4(50 - Y)/x$$

in the following manner. First, 0.2 to 0.5 g of a fully dried sample is weighed out accurately (this is x g) and immersed in 20 ml of a 1N-aqueous hydrogen chloride solution for at least 24 hours. 5 ml of the supernatant liquid or the filtrate is taken and titrated with a 0.1M aqueous caustic soda solution (the amount of the aqueous caustic soda solution consumed is y cc).

The hydrolyzed acrylic yarn containing introduced carboxyl groups can easily be prepared by hydrolyzing an acrylonitrile-based acrylic yarn with a mineral acid or an alkali and, in case where a mineral acid is used, contacting the saponificate with an alkali after hydrolysis to convert carboxyl groups into a salt finally. In this case, preferred salts are those of a cation selected from the group consisting of Li, K, Na and $NH_4$.

In the production of the twisted yarn, it is preferable to introduce, first, carboxyl groups into a single yarn and then twist the yarn, but it is also possible to twist, first, an acrylic yarn and then introduce carboxyl groups into the yarn.

Moreover, the inventors of this invention have found that even a hydrolyzed acrylic yarn which has a carboxyl content of higher than that specified above is converted by crosslinking to a hydrolyzed acrylic yarn which does not dissolve in water and is capable of fulfilling the object of this invention. Namely, this crosslinked hydrolyzed acrylic yarn fulfills the object of this invention and has a carboxyl content of 4.0 to 9.0 mmol/g, a degree of crosslinking of class 2 to class 6 and a degree of water swelling of 15 to 300 cc/g, and this yarn can provide an excellent twisted yarn by twisting the yarn so that the twist constant is at least 2.5.

Figure 4:
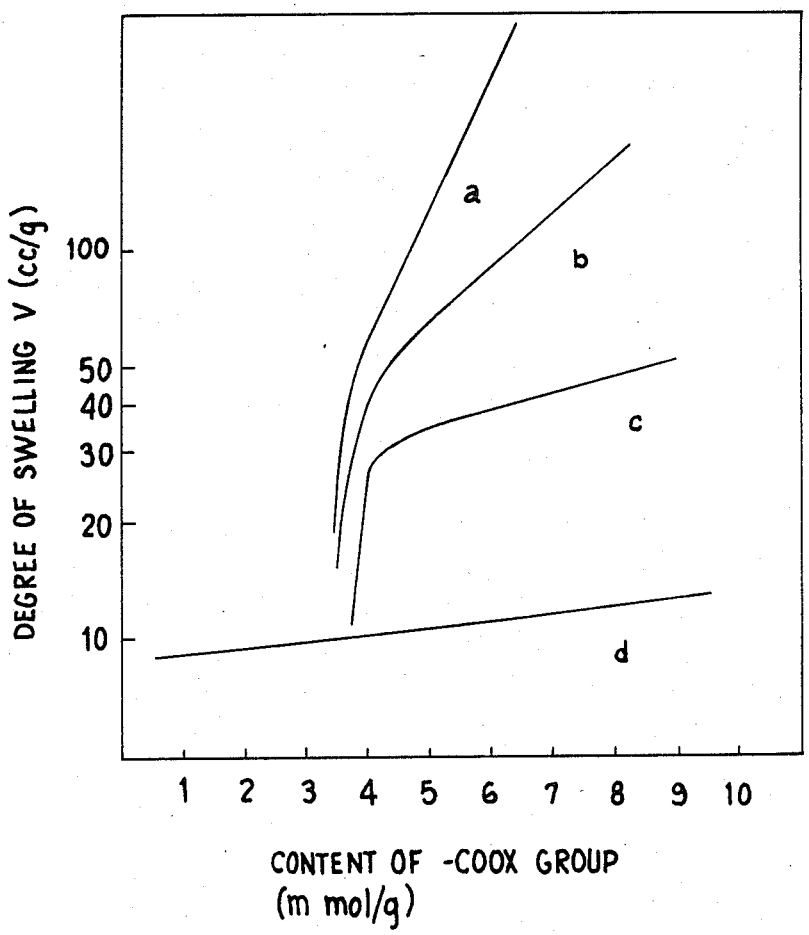
FIG. 4 is a graph used to determine a degree of crosslinking.

The degree of crosslinking of such a crosslinked hydrolyzed acrylic yarn is defined as follows. Namely, in the reaction system comprising hydrolyzing the nitrile groups contained in the polymer subsequent to or concurrent with formation of a crosslinked structure in an acrylonitrile-based acrylic yarn, the relationship between the content of sodium salt form carboxyl groups and the degree of swelling is plotted as shown in FIG. 4. Then, referring to the degree of swelling (V cc/g) with a sodium salt form carboxyl group content of 5 mmol/g, the degree of crosslinking of the crosslinked structure in this reaction system is defined as follows:

the degree of crosslinking class 1 $\log V \leqq 1.0$
class 2 $1.0 < \log V \leqq 1.2$
class 3 $1.2 < \log V \leqq 1.4$
class 4 $1.4 < \log V \leqq 1.6$
class 5 $1.6 < \log V \leqq 1.8$
class 6 $1.8 < \log V \leqq 2.0$
class 7 $2.0 < \log V$ FIG. 4 shows the relationships between the carboxyl content (in these cases, a sodium salt form carboxyl group) (mmol/g) and the degree of swelling V (cc/g) at various degrees of crosslinking. Curves a, b, c and d represent the relationships at degrees of crosslinking of 7, 5-6, 4 and 2, respectively.

A hydrolyzed acrylic yarn with a crosslinking degree of class 1 defined above shows low water absorption shrinkage because even if the content of salt-form carboxyl groups increases, the degree of swelling does not increase. Moreover, if the degree of crosslinking is below class 7, the yarn dissolves in water because of an excessively low degree of crosslinking. This is not favorable. At a degree of crosslinking in the range of class 2 to class 6, good results are obtained. Moreover, even in case of a hydrolyzed acrylic yarn with a degree of crosslinking of class 3 to 6, when a yarn has such an increased content of salt form carboxyl groups that a degree of water swelling of at least 300 cc/g is reached, the yarn shows a marked tendency toward dissolving in water. Accordingly, the degree of water swelling of a twisted yarn comprising crosslinked hydrolyzed acrylic yarn having water absorption shrinkage desired in this invention is preferably in the range of 10 to 300 cc/g, particularly preferably, in the range of 20 to 200 cc/g.

As processes for producing the twisted yarn comprising such a crosslinked hydrolyzed acrylic yarn, there are a process comprising previously forming a crosslinked structure in an acrylic yarn and then hydrolyzing the yarn and a process comprising carrying out crosslinking and introduction of carboxyl groups by hydrolysis simultaneously.

As the former process, there can be mentioned a process including chemical formation of a crosslinked structure by treatment with hydroxylamine or a diamine such as hydrazine or ethylenediamine, a process including formation of a crosslinked acrylic fiber having a latent crosslinkability or by a physical process including baking at 200° to 300° C., or irradiation with electron beams at a dose of above 100 Mrad, and then hydrolyzing the crosslinked yarn with a mineral acid or an alkali. As the latter process, there can be mentioned a process including treatment with a formalin-mineral acid system or a polyhydric alcohol-anhydrous mineral acid system, or a process including an alkaline treatment of an acrylic yarn containing 5 to 18% by weight of a copolymerized vinyl halide. By this method, it becomes possible to carry out the hydrolysis of nitrile groups and the formation of a crosslinked structure in one simultaneous step.

As the alkaline substances used in the hydrolysis, there can be mentioned aqueous solutions of a hydroxide, hydrogencarbonate or carbonate of lithium, sodium or potassium. As the mineral acids, there are preferred relatively high-concentration aqueous solutions of sulfuric acid, hydrochloric acid, phosphoric acid, nitric acid or the like. In case where a mineral acid is used, it is necessary to convert the yarn after hydrolysis into lithium, sodium, potassium or ammonia salt.

The twisted yarn of this invention can be prepared not only by twisting the acrylic single yarn containing introduced carboxyl groups but also by twisting a plurality of such yarns so that the twist constant is at least 2.5, or by twisting such a yarn together with other water-nonabsorbing shrinkable yarns, such as cotton yarn, rayon yarn or synthetic fiber yarns so that the twist constant is at least 2.5. In this case, however, at least 50% by weight of the resulting twist yarn consists of the acrylic yarn having introduced carboxyl groups. It is not preferred to use more than 50% by weight of the water-nonabsorbing shrinkable yarn because the shrinkage is lowered.

In case where a plurality of single yarns are twisted together, the direction in which the single yarns are twisted in preferably the same as that of twist of the single yarn, but the directions can be opposite to each other. Furthermore, in addition to a single yarn, a folded yarn can be used and a plurality of these folded yarns can be twisted together. Furthermore, in some applications, it is possible to obtain a greater shrinkage effect by twisting a plurality of the yarns of this invention.

Since the above-described twisted yarn of this invention has been given a twist which produces sufficient entanglement of fibers and an increased wet strength, they have properties as strong water-swellable yarns 1 (FIG. 1). Moreover, the twisted yarns have a feature that when they are given a twist and subjected to twist setting, no twist recovery occurs before absorption of water, but it does occur after absorption of water because the fibers themselves swell and take a reef knot-like form 1' (FIG. 2) with consequent formation of gaps around the yarns. Thus, more water is absorbed by these gaps.

The twisted yarn of this invention having the above-mentioned feature can be applied to a variety of fields. Typical examples of its application are illustrated below.

One of the applications of this invention includes cloth diapers. For example, if the water absorption shrinkable twisted yarns of this invention are sewn into a cloth diaper, the twisted yarns shrink and wrinkle the cloth diaper when the latter is wetted with urine, thereby enabling retention of more urine in spaces provided by the wrinkles.

In this case, it is possible to weave the twisted yarn of this invention as the warps or wefts of a cloth diaper.

Another application includes disposable absorbent articles. For example, the twisted yarns of this invention are sewn into the top layer of a physiological napkin or a paper diaper, that is, nonwoven fabric. The water-absorbing articles thus prepared do not give an unpleasant feeling to the user, because when excretions penetrate the top layer and are absorbed by the absorbent, the water-absorbent shrinkable twisted yarns are wetted and shrink to form wrinkles on the top layer, thus providing gaps between the user and the absorbent.

In still another application, it is possible is a disposable diaper fitted with an elastomer material on the edges around the lower thigh portions, to use the twisted yarn of this invention instead of the elastomer material. Namely, in its use, gaps can be formed around the thighs because the yarns ordinarily do not show elasticity and cause no stuffiness whereas they shrink to fit the edges of a diaper to the thighs and prevent leakage only when they are wetted with urine.

The twisted yarn of this invention can be applied to a variety of uses in addition to the above-described application examples.

This invention will be described below with reference to examples. It should be noted that this invention is not limited to these examples.

EXAMPLE 1

Carboxymethylated Cotton Yarn degree of carboxymethylation: 0.29
degree of swelling: 56 cc/g
form of twist: three yarns (count 33.8) are Z-twisted. (herinafter referred to as 33.8 s/sZ).
twist constant: 3.0

EXAMPLE 2

Methylated Cotton Yarn degree of etherification: 0.25
degree of swelling: 12 cc/g
form of twist: 33.8 count Z
twist constant: 2.5

EXAMPLE 3

Sulfated Cotton degree of esterification: 0.20
degree of swelling: 48 cc/g
form of twist: 16.9 s (Z-twist)
twist constant: 4.0

EXAMPLE 4

Cationized Cotton degree of cationization: 0.25
degree of swelling: 11 cc/g
form of twist: 33.8 s/2 Z
twist constant: 3.0

EXAMPLE 5

Sulfated Cotton degree of esterification: 0.20
degree of swelling: 48 cc/g
form of twist: 16.9 s/3 Z (one of the three yarns is a cotton yarn)
twist constant: 4.5

EXAMPLE 6

Carboxymethylated Cotton degree of carboxymethylation: 0.17
degree of swelling: 18 cc/g
form of twist: 33.8 s/3 (one of the three yarns is a cotton yarn)
twist constant: 3.0

COMPARATIVE EXAMPLE 1

A twisted yarn of Example 2, wherein the degree of etherification is 0.21, and the degree of water swelling is 7 cc/g.

COMPARATIVE EXAMPLE 2

A twisted yarn of Example 3, wherein the twist constant is 2.0.

COMPARATIVE EXAMPLE 3

A twisted yarn of Example 6, wherein the form of twist is such that two of the three yarns are cotton yarns.

The twisted yarns of Examples 1 to 6 and Comparative Examples 1 to 3 were tested for a degree of water swelling, strength and water absorption. The results are shown in Table 1.

Figure 3:
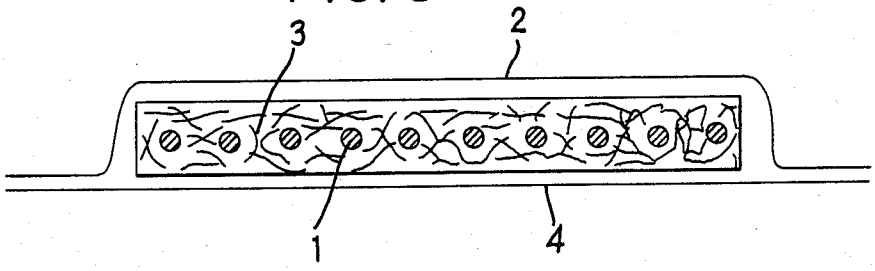
FIG. 3 is a cross-sectional view of an example of an absorbent prepared by using a twisted yarn of this invention.

Test Procedures for Water Absorption 4 g of a twisted yarn 1 of the above Examples and Comparative Examples are blended with 26 g of cotton pulp 3 (Weahouser Co., Ltd., SAM) as shown in FIG. 3. In FIG. 3, the top sheet 2 comprises a nonwoven fabric (20 g/m$^2$) prepared by hot-melting of polyester fiber (45%) and ES fiber (55%), and the back sheet 4 comprises polyethylene (25 g/m$^2$). These sheets are composed as shown in FIG. 3. To the thus composed absorbent is poured artificial urine (prepared by adjusting a physiological saline solution to a surface tension of 50 dyne/cm±3 dyne/cm at 30° C.) through a hole, 1 cm across, of a container placed on the surface of the absorbent. The time required to absorb 105 cc of the urine is measured and this time is defined as an absorption time. Further, 2 minutes after the absorption, a load (40 g/cm$^2$) is applied to the area (100 cm$^2$) around the site of absorption and the urine oozing out of the absorbent is absorbed by a filter paper. The amount of the urine thus absorbed is defined as return. The water absorption is represented by this absorption time and the return.

Figure 2:
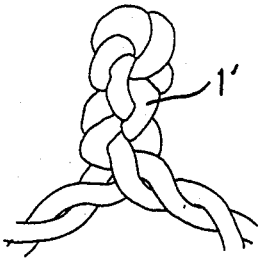
FIG. 2 is a side view of a top portion formed when the twisted yarn shown in FIG. 1 absorbs water.

The reason why the absorbents incorporated with the twisted yarn of this invention show excellent water absorption as shown in Table 1 is perhaps that the liquid retention is increased in such a manner that when an absorbent is wetted, the twisted yarns take a reef knot-like form as shown in FIG. 2 at various points and provide gaps around the twisted yarns in the pulp.

TABLE 1

| | degree of water swelling (cc/g) | yarn wet strength (g/yarn) | water absorption absorption time (sec) | water absorption return (g) |
|---|---|---|---|---|
| Ex. 1 | 56 | 423 | 130 | 5.1 |
| Ex. 2 | 12 | 127 | 156 | 6.8 |
| Ex. 3 | 48 | 140 | 131 | 5.4 |
| Ex. 4 | 11 | 309 | 160 | 6.7 |
| Ex. 5 | 48 | 525 | 139 | 5.4 |
| Ex. 6 | 18 | 594 | 152 | 6.5 |
| Compar. Ex. 1 | 7 | 176 | 180 | 7.6 |
| Compar. Ex. 2 | 48 | 38 | 169 | 7.0 |
| Compar. Ex. 3 | 18 | 881 | 177 | 7.3 |
| absorbent comprising cotton pulp only (30 g) | | | 195 | 7.8 |

Examples of the twisted yarn of a hydrolyzed acrylic yarn of this invention are set forth below.

Acrylic yarn used: Vonnel, a product of Mitsubishi Rayon Co., Ltd.

EXAMPLE A carboxyl content (Na salt): 0.7 mmol/g
form of twist: three yarns (count 17) are Z-twisted. (hereinafter referred to as 17 s/3 Z)
twist constant: 2.5

EXAMPLE B carboxyl content (Na salt): 1.9 mmol/g
form of twist: 17 s/3 Z
twist constant: 3.5

EXAMPLE C carboxyl content (Na salt): 3.4 mmol/g
form of twist: 17 s Z
twist constant: 5.0

EXAMPLE D carboxyl content (K salt): 2.1 mmol/g
form of twist: 26 s/3 Z
twist constant: 4.0

EXAMPLE E carboxyl content ($NH_4$ salt): 2.1 mmol/g
form of twist: 26 s/3 Z
twist constant: 4.0

EXAMPLE F carboxyl content (Li salt): 2.1 mmol/g
form of twist: 26 s/3 Z
twist constant: 4.0

EXAMPLE G

Crosslinked Hydrolyzed Acrylic Yarn (formalin crosslinking)

carboxyl content (Na salt): 6.9 mmol/g
degree of water swelling: 51 cc/g
degree of crosslinking: class 5
form of twist: 17 s/3 Z
twist constant: 2.5

EXAMPLE H

A yarn of Example G, wherein the carboxyl content is 8.5 mmol/g, the degree of crosslinking is class 4, the salt is an $NH_4$ salt and the twist multiplier is 4.0.

carboxyl content ($NH_4$ salt): 8.5 mmol/g
degree of water swelling: 250 cc/g
degree of crosslinking: class 4
form of twist: 17 s/3 Z
twist constant: 4.0

EXAMPLE I (hydroxylamine crosslinking)

carboxyl content (Na salt): 4.2 mmol/g
degree of water swelling: 12 cc/g
degree of crosslinking: class 2
form of twist: 17 s/3 Z
twist constant: 3.0

EXAMPLE J

A twisted yarn of Example I, wherein the carboxyl content is 5.8 mmol/g, the degree of crosslinking is class 6 and the twist multiplier is 6.0.

(hydroxylamine crosslinking)

carboxyl content (Na salt): 5.8 mmol/g
degree of water swelling: 85 cc/g
degree of crosslinking: class 6
form of twist: 17 s/3 Z
twist constant: 6.0

EXAMPLE K carboxyl content (Na salt): 0.7 mmol/g
form of twist: 17 s/3 Z (one of the three yarns is an unreacted acrylic yarn)
twist constant: 3.0

EXAMPLE L carboxyl content (Na salt): 1.5 mmol/g
form of twist: 26 s/3 Z (one of the three yarns is an unreacted acrylic yarn)
twist constant: 5.0

EXAMPLE M carboxyl content (Na salt): 1.5 mmol/g
form of twist: 26 s/3 S
twist constant: 3.5
twist direction of single yarn (first twist): right hand twist
twist direction of twisted yarn (ply twist): left hand twist

COMPARATIVE EXAMPLE A

A yarn of Example A, wherein the carboxyl content is 0.5 mmol/g.

COMPARATIVE EXAMPLE B

A yarn of Example A, wherein the twist constatnt is 2.0.

COMPARATIVE EXAMPLE C

A yarn of Example C, wherein the carboxyl content is 4.2 mmol/g.

COMPARATIVE EXAMPLE D

A yarn of Example K, wherein the form of twist is such that two of the three yarns are unreacted acrylic yarns.

COMPARATIVE EXAMPLE E

A yarn of Example I, wherein the degree of crosslinking is class 1.

carboxyl content: 4.3 mmol/g
degree of water swelling: 5 cc/g
degree of crosslinking: class 1

COMPARATIVE EXAMPLE F

A yarn of Example I, wherein the carboxyl content is 2.5 mmol/g.

carboxyl content: 2.5 mmol/g
degree of water swelling: 9 cc/g
degree of crosslinking: class 2

The twisted yarns of Examples A and M and Comparative Examples A to F were measured for water absorption shrinkage force and shrinkage rate by the following method. The results are shown in Table 2.

shrinkage force: a force of shrinkage produced by a yarn when it is wetted with water (expressed in g)

shrinkage rate = (initial length of yarn − length at shrinkage)/initial length of yarn × 100

TABLE 2

| | Shrinkage force [g] | shrinkage rate [%] |
|---|---|---|
| Ex. A | 14 | 13 |
| Ex. B | 48 | 73 |
| Ex. C | 93 | 85 |
| Ex. D | 65 | 79 |
| Ex. E | 80 | 86 |
| Ex. F | 62 | 77 |
| Ex. G | 21 | 19 |
| Ex. H | 95 | 88 |
| Ex. I | 18 | 20 |
| Ex. J | 147 | 91 |
| Ex. K | 12 | 11 |

TABLE 2-continued

| | Shrinkage force [g] | shrinkage rate [%] |
|---|---|---|
| Ex. L | 39 | 63 |
| Ex. M | 28 | 42 |
| Compar. Ex. A | 6 | 5 |
| Compar. Ex. B | 7 | 4 |
| Compar. Ex. C | dissolved | |
| Compar. Ex. D | 3 | 3 |
| Compar. Ex. E | 4 | 3 |
| Compar. Ex. F | 7 | 5 |

The embodiments of the invention in which an exclusive privilege or property is claimed are defined as follows:

1. A twisted yarn prepared by twisting a starting yarn comprising at least 50% by weight of water-insoluble, water-swellable fibers having a degree of water swelling of at least 10 cc/g so that the twist constant of the twisted yarn is at least 2.5, said water-insoluble, water-swellable fibers being hydrolyzed acrylic fibers in which carboxylate groups of the formula —COOX, wherein X is Li, K, Na or $NH_4$, are present in an amount of 0.7 to 4.0 mmol/g.

2. A twisted yarn as defined in claim 1 which is prepared by twisting a single yarn of said water-insoluble, water-swellable fiber.

3. A twisted yarn as defined in claim 1 which is prepared by twisting together a plurality of single yarns of said water-insoluble, water-swellable fiber.

4. A twisted yarn as defined in claim 1 which is prepared by twisting together at least one yarn of said water-insoluble, water-swellable fiber and at least one non-water-swellable yarn.

5. A twisted yarn prepared by twisting a starting yarn comprising at least 50% by weight of water-insoluble, water-swellable fibers having a degree of water swelling of 10 to 300 cc/g so that the twist constant of the twisted yarn is at least 2.5, said water-insoluble, water-swellable fibers being hydrolyzed acrylic fibers in which carboxylate groups of the formula —COOX, wherein X is Li, K, Na or $NH_4$, are present in an amount of 4.0 to 9.0 mmol/g , said hydrolyzed acrylic fibers having a degree of crosslinking of class 2 to class 6.

6. A twisted yarn as defined in claim 5 which is prepared by twisting a single yarn of said water-insoluble, water-swellable fiber.

7. A twisted yarn as defined in claim 5 which is prepared by twisting together a plurality of single yarns of said water-insoluble, water-swellable fiber.

8. A twisted yarn as defined in claim 5 which is prepared by twisting together at least one yarn of said water-insoluble, water-swellable fiber and at least one non-water-swellable yarn.

* * * * *